US006948463B2

(12) United States Patent
Mischker et al.

(10) Patent No.: US 6,948,463 B2
(45) Date of Patent: Sep. 27, 2005

(54) CYLINDER HEAD

(75) Inventors: Karsten Mischker, Leonberg (DE); Michael Huebel, Gerlingen (DE); Uwe Hammer, Hemmingen (DE); Volker Beuche, Stuttgart (DE); Peter Lang, Weissach (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/473,311

(22) PCT Filed: Nov. 28, 2002

(86) PCT No.: PCT/DE02/04368

§ 371 (c)(1),
(2), (4) Date: Apr. 6, 2004

(87) PCT Pub. No.: WO03/064824

PCT Pub. Date: Aug. 7, 2003

(65) Prior Publication Data

US 2004/0154565 A1 Aug. 12, 2004

(30) Foreign Application Priority Data

Jan. 29, 2002 (DE) ..... 102 03 273

(51) Int. Cl.[7] ..... F01L 9/02

(52) U.S. Cl. ..... 123/90.12; 123/90.11; 123/90.15; 123/195 A; 251/30.01; 251/57; 251/129.03; 251/143; 251/149.9

(58) Field of Search ..... 123/90.11–90.13, 123/90.15, 193.1–193.3, 193.5, 195 A, 195 AC, 195 HC, 198 F; 251/26, 28, 29, 30.01, 57, 129.03, 129.15, 142, 143, 149, 149.9, 341–344

(56) References Cited

U.S. PATENT DOCUMENTS

| | | | | |
|---|---|---|---|---|
| 4,244,553 A | * | 1/1981 | Escobosa | 251/57 |
| 5,231,959 A | * | 8/1993 | Smietana | 123/90.12 |
| 5,517,951 A | | 5/1996 | Paul et al. | |
| 6,584,951 B1 | * | 7/2003 | Patel et al. | 123/198 F |

FOREIGN PATENT DOCUMENTS

| | | |
|---|---|---|
| DE | 33 47 533 | 7/1985 |
| DE | 198 26 047 | 12/1999 |
| EP | 0 520 633 | 12/1992 |

* cited by examiner

*Primary Examiner*—Thomas Denion
*Assistant Examiner*—Kyle M. Riddle
(74) *Attorney, Agent, or Firm*—Kenyon & Kenyon

(57) ABSTRACT

A cylinder head for a combustion cylinder of an internal combustion engine is provided, which has at least one inlet opening and at least one outlet opening, as well as gas exchange valves which are operable by electrohydraulic valve actuators, some of which gas exchange valves function as inlet valves to control the at least one inlet opening, and some of which gas exchange valves function as outlet valves to control the at least one outlet opening. For the purpose of producing a compact, complete module which, as a separate component, may be tested for reliability and may be installed into the engine block of the internal combustion engine without additional preassembly effort, the cylinder head is provided with at least one high pressure line for supplying fluid under high pressure and at least one recycling line for recycling fluid, which have coupling openings for the hydraulic coupling of the valve actuators, and also means for fastening the valve actuators are provided.

5 Claims, 3 Drawing Sheets

CYLINDER HEAD

FIELD OF THE INVENTION

The present invention relates to a cylinder head for a combustion cylinder of an internal combustion engine.

BACKGROUND INFORMATION

In an internal combustion engine having electrohydraulic valve control, a type of which is described, for example, in published German patent document DE 198 26 047, fluid under high pressure, e.g., hydraulic oil, is supplied to the electrohydraulic valve actuators for operating the gas exchange valves, and, at the same time, fluid under low pressure is carried off from the valve actuators and fed back to a fluid reservoir. The valve actuators each have a double-acting working cylinder having an operating piston, which is shiftable inside the cylinder, connected to the associated gas exchange valve, which subdivides the working cylinder into two hydraulic working chambers. By appropriate pressure control of the fluid in the working chambers using two electrical control valves, e.g., 2/2-way solenoid valve, the operating piston is shifted into one or the other direction, and thereby the associated gas exchange valve is opened in a defined manner or closed completely.

SUMMARY

The cylinder head according to the present invention has the advantage that, together with the mounting of the valve actuators for operating the gas exchange valves, the fluid supply of the valve actuators is produced at the same time. The cylinder head equipped with the valve actuators forms a compact module, which may be tested for reliability as a separate component and delivered to the customer. The customer only has to set the module onto the combustion cylinders of the motor block, and, without additional pre-assembly effort, the customer is thus able to obtain the internal combustion engine having a structurally prearranged, functionally tested electrohydraulic valve control.

According to one example embodiment of the present invention, two line pairs are present which are each formed by one high pressure line and one return line, which may run parallel to each other at the cylinder head. One pair of lines has the coupling openings for the valve actuators of the inlet valves, and the other pair of lines has the coupling openings for valve actuators of the outlet valves.

By these measures, the fluid supply takes place for the inlet and the outlet side via separate hydraulic lines, which are also referred to as rails.

According to one example embodiment of the present invention, the high pressure lines and the recycling lines are integrated into the cylinder head, i.e., they are produced either when the cylinder head is cast, or by a further processing procedure, for example, by drilling or cutting.

According to one example embodiment of the present invention, the high pressure lines are designed as separate components and fixed to the cylinder head. This makes possible the use of materials which have a greater strength than the cylinder head which is usually manufactured by die casting aluminum. In this context, high pressure lines may be clamped to the cylinder head using retaining clips, which, on their part, are screwed to the cylinder head. Alternatively, it is also possible to cast in the high pressure lines by laying them into the mold as the core during die casting, and thus having the material of the cylinder head flow around them.

According to one example embodiment of the present invention, the means for fixing the valve actuators at the cylinder head have centering openings and threaded holes which are put into the outer cylinder head surface, the centering openings being used at the same time for putting through the valve shafts of the gas exchange valves.

According to one further example embodiment of the present invention, at least one leakage line is also provided in the cylinder head for recycling leakage fluid which are connected to the centering openings via connecting channels. In this context, one leakage line is may be allocated to each line pair of a high pressure line and a recycling line, which runs parallel to the line pair and is integrated into the cylinder head. Fluid leakages in the valve actuators are carried off via the leakage lines, and in this context, may be separated for the inlet and outlet side.

DETAILED DESCRIPTION

Figure 1:
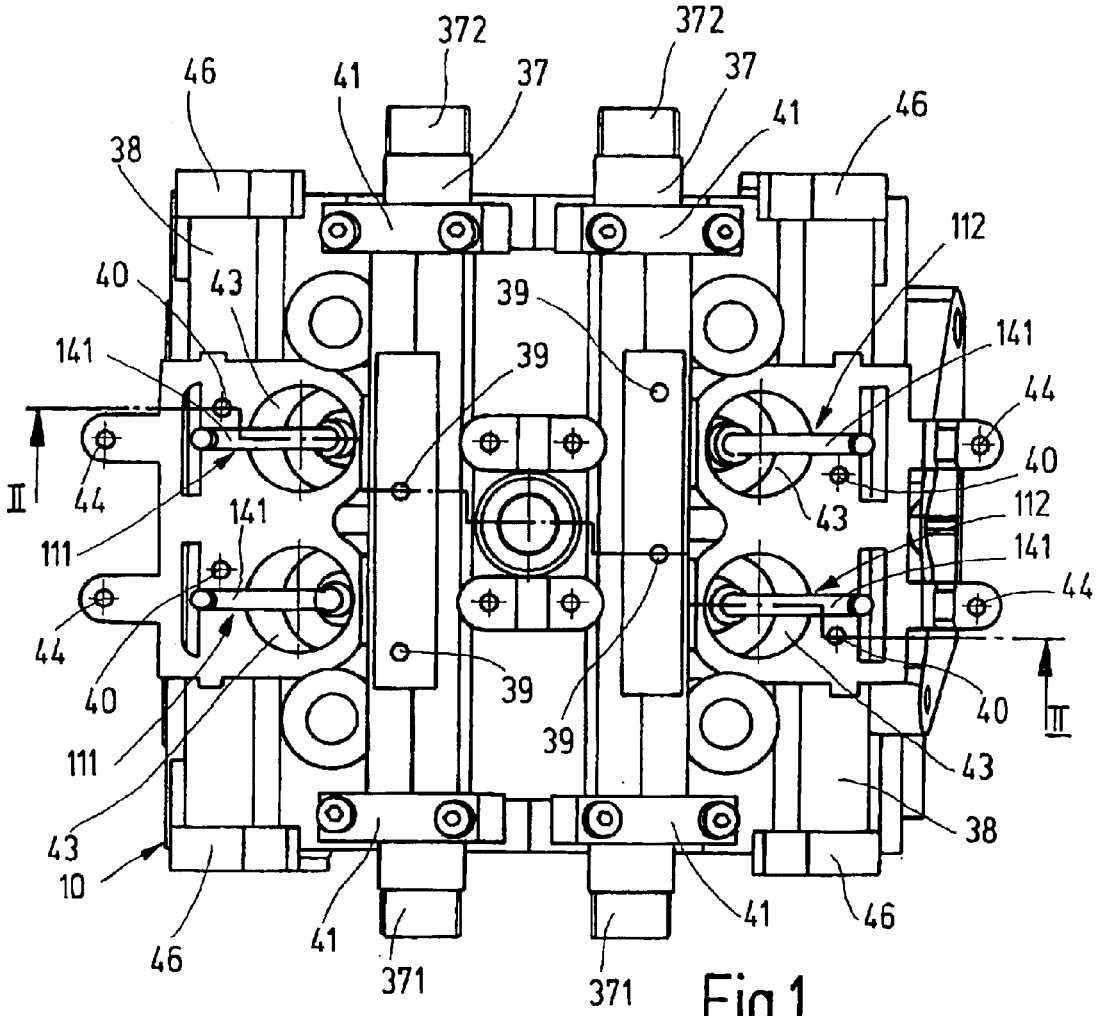
FIG. 1 shows a top view of a cylinder head for a combustion cylinder of an internal combustion engine according to the present invention.
Figure 2:
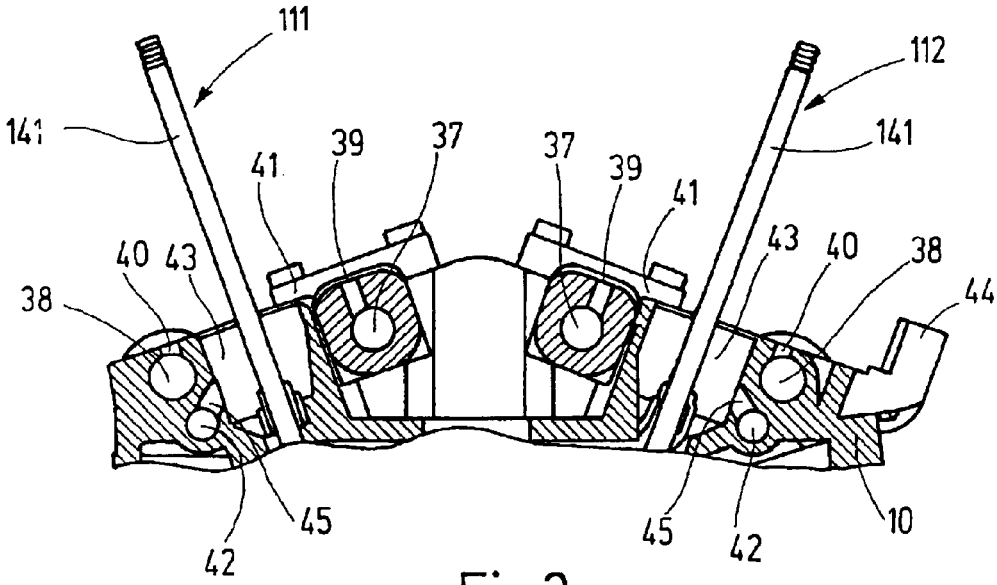
FIG. 2 shows a cutout view of a section along line II—II shown in FIG. 1.

Cylinder head 10 for a combustion cylinder for an internal combustion engine, as shown in a top view in FIG. 1 and in a sectional view in FIG. 2, is provided with four gas exchange valves 11, of which only valve shafts 111 are shown in FIGS. 1 and 2.

Figure 7:
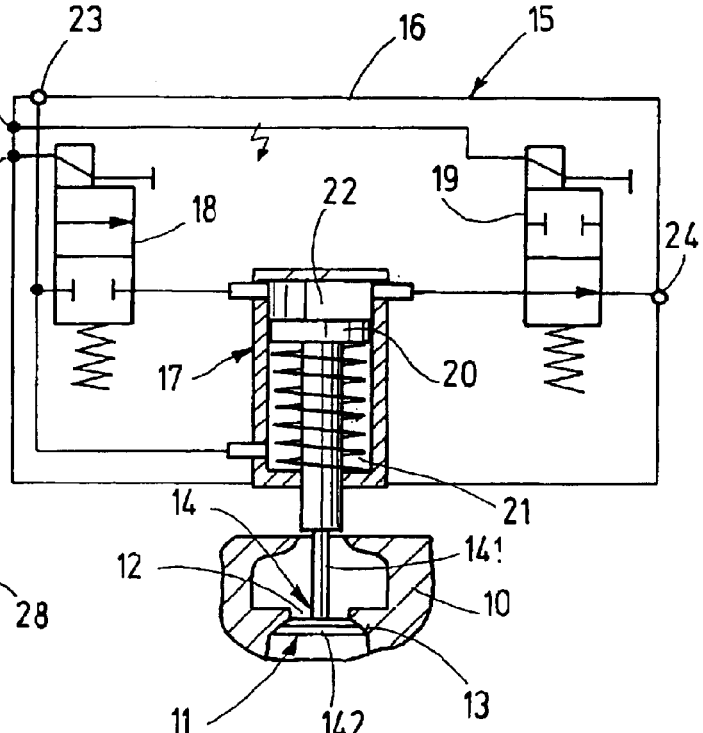
FIG. 7 is a block diagram of a valve actuator for illustrating the functions.

In FIG. 7, a cutout of cylinder head 10 in the region of a gas exchange valve 11 is shown in section. The gas exchange valve 11 closes off an opening 12 in cylinder head 10, which, on its part, is set up on the combustion cylinder, and closes off a combustion chamber developed in the combustion cylinder in a gastight manner. Gas exchange valve 11 has a valve seat 13, which encloses opening 12 in cylinder head 10, and a valve element 14 having a valve closing body 142, sitting on an axially, shiftably guided valve shaft 141, which cooperates with valve seat 13 for closing and freeing opening 12. By displacement of valve shaft 141 in one axial direction or the other, valve closure element 142 lifts off from valve seat 13 or seats itself on valve seat 13.

As seen in FIGS. 1 and 2, of the four gas exchange valves 11, in each case two are situated side by side, and the two pairs of gas exchange vales 11 are placed centrosymmetrically on cylinder head 10. In this context, one pair of gas exchange valves 11 forms inlet valves 111, and another pair of gas exchange valves 11 placed centrosymmetrically to it forms outlet valves 112 for the combustion chamber in the combustion cylinder. Each inlet valve 111 controls an inlet opening 12 using its valve member 142, and each outlet valve 112 controls an outlet opening 12 using its valve member 142.

Each gas exchange valve 11 is operated by an electrohydraulic valve actuator 15. The construction and the operation of electrohydraulic valve actuator 15 are conventional (cf published German patent document DE 198 26 047), and an example embodiment is shown in FIG. 7 as a block diagram. Valve actuator 15 has an actuator housing 16, in which a double-acting, hydraulic working cylinder 17 and two electrical control valves 18, 19, designed, for example, as a 2/2-way solenoid valves, are accommodated. An operating piston 20, connected to valve shaft 141 of exchange gas valve 11, is movably guided in working cylinder 17, and it subdivides working cylinder 17 into a lower working space 21 and an upper working space 22. Lower working space 21 is connected directly, and upper working space 22 is connected via first control valve 18, to a fluid inflow opening 23 in actuator housing 16. Upper working space 22 is also connected to a fluid outlet opening 24 in actuator housing 16 via second control valve 19. The piston surface of operating piston 20 bordering on upper working space 22 is greater than the piston surface of actuator piston 20. Control valves 18, 19 are controlled electrically, for which electrical connecting contacts 25, 26 are present at actuator housing 16.

Figure 3:
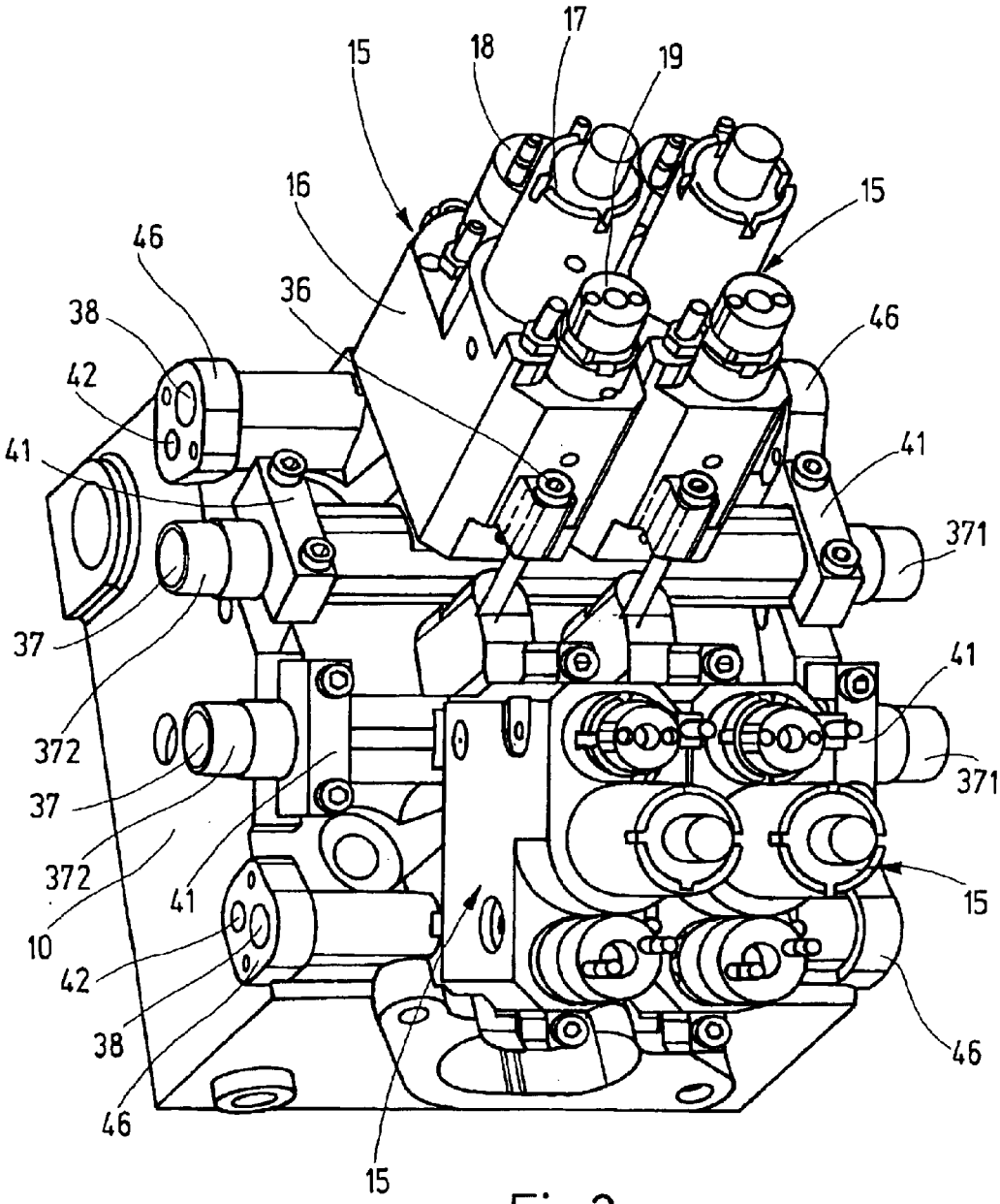
FIG. 3 shows a perspective view of a cylinder head shown in FIG. 1, preassembled into a complete module that is able to be functionally tested by having valve actuators set on it.
Figure 4:
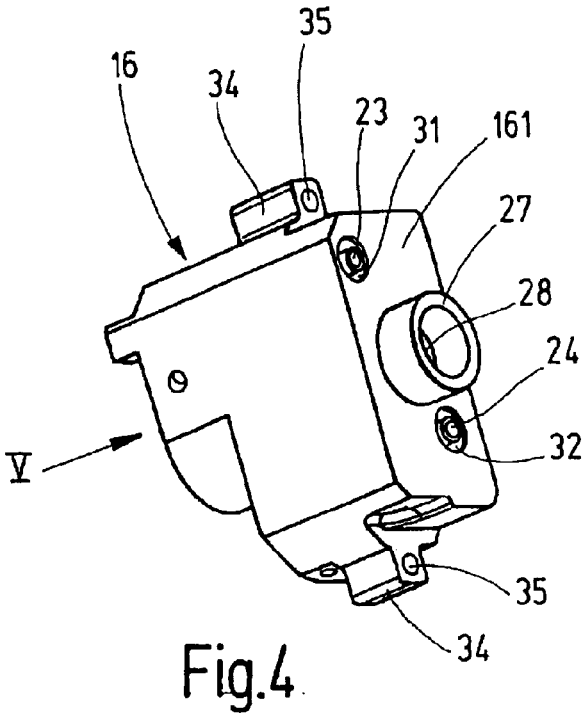
FIG. 4 shows a perspective view of an actuator housing of the valve actuator shown in FIG. 3.
Figure 5:
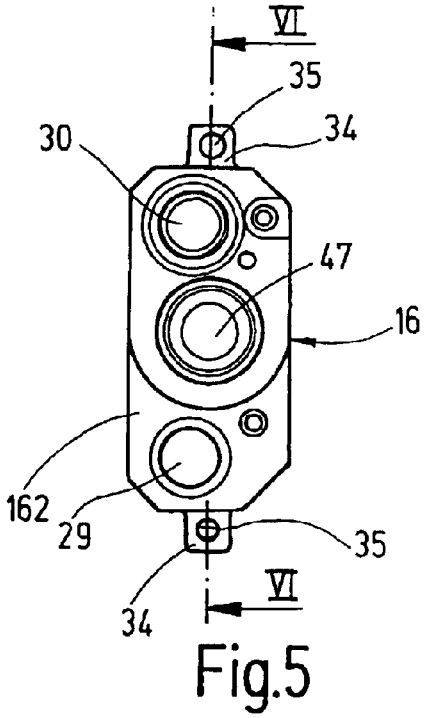
FIG. 5 shows a side view of the actuator housing in the direction of arrow V in FIG. 4.
Figure 6:
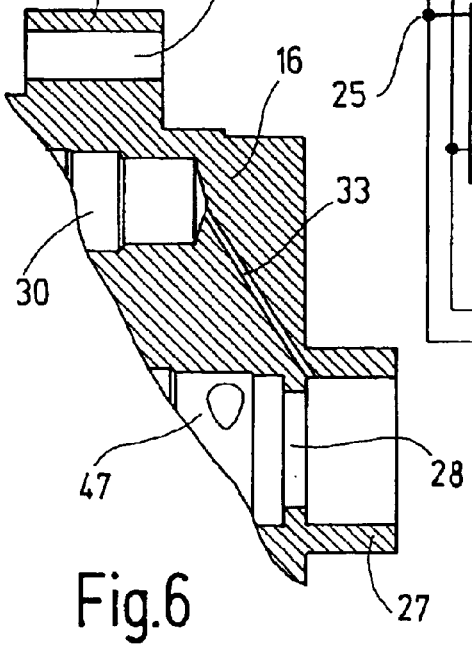
FIG. 6 shows a cutout view of a section along line VI—VI shown in FIG. 5.

In FIG. 4 and FIG. 5, activator housing 16 is shown (without a hydraulic working cylinder and electrical control valves) in two different views. Fluid supply opening 23 and fluid outflow opening 24 are situated in a planar housing surface 161. Concentric with fluid supply opening 23, a ring groove 31 is provided in the housing surface 161, and concentric with fluid outflow opening 24, a ring groove 32 is provided in the housing surface 161, which are used for accommodating a sealing ring not shown here. In the same housing surface 161, a leadthrough passage 28 (FIG. 6) concentrically enclosed by a hollow stud 27 projecting from housing surface 161 has been put in. Coaxial to leadthrough passage 28 and hollow peg 27, a hollow space 47 is situated in actuator housing 16, for accommodating working cylinder 17. In addition, two blind hole accommodating chambers 29, 30 are provided, which open out on housing surface 162 that faces away from housing surface 161 (FIG. 5). Accommodating chambers 29, 30 are used to accommodate control valves 18, 19, which are pushed into accommodating chambers 29, 30 from the direction of housing surface 162. As shown by the sectional representation in FIG. 6 for accommodating chamber 30, which may be seen as a cutout, a connecting channel 33 runs from the bottom of accommodating chamber 30 to the inside of hollow peg 27, via which a fluid leakage, exiting at electrical control valve 18, may be carried off to leadthrough passage 28. Although not shown in FIG. 6, the same kind of connecting channel leads to accommodating chamber 29. As shown in FIGS. 4 and 5, protruding lugs are formed onto the narrow sides, facing away from each other, of actuator housing 16, in each of which protruding lugs a leadthrough bore 35 is provided for leading through fastening means, e.g., a screw 36 (FIG. 3). Leadthrough bores 35 run parallel to the axis of hollow stud 27.

In FIG. 3, actuator housing 16 is completed by working cylinder 17 and control valves 18, 19 in an example embodiment. In each case, one valve actuator 15 is used to operate a gas exchange valve 11, so that in the case of cylinder head 10 shown in FIG. 1, four valve actuators have to be fastened to cylinder head 10 using four exchange valves 11, in each case valve shaft 141 of allocated gas exchange valve 11 having to be coupled to operating piston 20 in working cylinder 17.

Now, cylinder head 10 may be viewed in such a way that when valve actuators 15 are set upon cylinder head 10 and fastened to cylinder head 10, the fluid supply of valve actuators 15 is ensured. As shown in FIGS. 1 and 2, for this purpose, two high pressure lines 37, so-called high pressure rails, are provided, for supplying fluid under high pressure to valve actuators 15, and two recycling lines 38, so-called recycling rails, are provided for carrying off fluid under low pressure from valve actuators 15 for the purpose of recycling to a fluid reservoir. High pressure lines 37 and recycling lines 38 run parallel to each other, and a pair of lines consisting of a high pressure line 37 and a recycling line 38 is allocated to inlet valves 111, and another pair of lines consisting of high pressure line 37 and a recycling line 38 is allocated to outlet valves 112. High pressure lines 37 and recycling lines 38 are furnished with coupling openings 39 and 40, respectively, for the hydraulic coupling of valve actuators 15. The number of the coupling openings 39 in high pressure lines 37 is equal to the number of coupling openings 40 in recycling lines 38, and corresponds to the number of inlet valves 111 and outlet valves 112, respectively. In the exemplary embodiment of FIGS. 1 and 2, high pressure lines 37 are designed as separate components, which are firmly clamped on cylinder head 10 using retaining clips 41, which, on their part, are screwed to cylinder head 10. Recycling lines 38 are integrated into cylinder head 10 and are produced either already at the time cylinder head 10 is cast, or are drilled into cylinder head 10 by an additional processing procedure. Furthermore, in cylinder head 10, leakage lines 42, also referred to as leakage rails, are also integrated, which are produced in the same way as recycling lines 38. One leakage line 42 is allocated to each pair made up of high pressure line 37 and recycling line 38, and the leakage line 42 runs parallel to high pressure line 37 and recycling line 38.

For the purpose of coupling valve actuator 15 to cylinder head 10, fixing means are provided on cylinder head 10, which include centering openings 43 and threaded holes 44. Each centering opening 43 accommodates hollow peg 27, which protrudes from the actuator housing of valve actuator 15, in a form-locking manner, while threaded holes 44 are placed congruently with the two leadthrough bores 35 present at each actuator housing 16. Centering openings 43 are used at the same time for guiding through valve shafts 141 of gas exchange valves 11. Furthermore, coupling openings 39, 40 are situated in such a way that, when actuator housings 16 are mounted using hollow studs 27 submerging into centering opening 43, fluid supply openings 23 set themselves congruently on coupling openings 39 in high pressure line 37, and fluid outflow openings 24 set themselves congruently on coupling openings 40 in recycling line 38. The sealing rings lying in ring grooves 31, 32 provide for a liquid-tight connection between fluid supply and fluid removal openings 23, 24 in actuator housing 16 and coupling openings 39, 40, when actuator housings 16 are pressed onto cylinder head 10 by screwing down screws 36 in threaded holes 44, which are guided through leadthrough bores 35 on actuator housing 16. By setting hollow pegs 27 into centering openings 43, valve shafts 141 of gas exchange valves 11, extending through centering openings 43, are simultaneously coupled to operating pistons 20 of working cylinders 17.

As seen from the sectional representation in FIG. 2, centering openings 43 are connected to leakage lines 42 via connecting channels 45, and specifically, centering openings 43 allocated to inlet valves 111 are connected to leakage line 42, and centering openings 43, which are allocated to outlet valves 112, are connected to the other leakage line 42. By the use of these connecting channels 45, the fluid leakages occurring in valve actuators 15, i.e., on the one hand, at working cylinder 17 and, on the other hand, in control valves 18, 19, are conducted into leakage lines 42 and from there recycled into a fluid reservoir.

FIG. 3 shows cylinder head 10 equipped with four valve actuators 15, which represent a compact, complete module having a functionally testable electrohydraulic valve control, which additionally only has to be mounted gas-tight on a combustion cylinder in the motor block of an internal combustion engine and connected to a fluid supply system. In this context, in the drawings only a one-cylinder variant is shown. By concatenating several such modules according to FIG. 3, it is possible to implement in-line engines and V engines having any number of cylinders. For this, high pressure lines 37, recycling lines 38 and leakage lines 42 are designed at their ends in such a way that, for coordination of a like module, the ends of the lines 37, 38, 42 that are put together may be fitted into one another in a liquid-tight manner or may be otherwise joined together in a liquid-tight manner. As FIG. 3 makes clear, in this connection high pressure lines 37 are plugged into one another using appropriately designed projections 371 and 372, while high pressure lines 37 and leakage lines 42 open out into flanges 46, which are set together flat while a seal is placed between them, and screwed together with each other. Alternatively, it is also possible to produce multi-cylinder variants in one part, i.e., to cast all cylinder heads in one piece. All the lines or rails 37, 38, 42 are then drilled through the entire multicylinder head, and all the cylinders are supplied through the rails.

The present invention is not limited to the above-described exemplary embodiments. Thus, for example, recycling lines 38 may be cast as a separate component onto cylinder head 10. In order to do that, high pressure lines 37 are laid like a core into the mold during the mold casting process, so that they have the material of cylinder head 10 flowing around them, and thereby a connection to cylinder head 10 is created.

High pressure lines 37 may be integrated into cylinder head 10 just as are recycling lines 38 and leakage lines 42, in that they are produced during the casting of cylinder head 10, or are drilled during a further operating procedure. The advantage of high pressure lines 37 produced as separate components is the possibility of using materials having a greater strength than the aluminum die casting of cylinder head 10.

What is claimed is:

1. A module for at least one combustion cylinder of an internal combustion engine having electrohydraulic valve control, comprising:

a cylinder head having a plurality of gas exchange valves, at least one gas exchange valve functioning as an inlet valve to control the at least one inlet opening, and at least one other gas exchange valve functioning as an outlet valve to control the at least one outlet opening, at least one high pressure line for supplying fluid under high pressure, at least one recycling line for recycling of fluid, wherein the at least one high pressure line and the at least one recycling line each have at least one coupling opening for hydraulic coupling of the electrohydraulic valve actuators;

a plurality of electrohydraulic valve actuators; and an arrangement for detachably fastening the electrohydraulic valve actuators;

wherein the number of the electrohydraulic valve actuators corresponds to the number of the gas exchange valves present, and wherein each valve actuator has an actuator housing, the housing having a planar surface with a fluid supply opening, a fluid outflow opening and a leadthrough passage enclosed by a projecting hollow peg for allowing passage of a valve shaft of a gas exchange valve, wherein the fluid supply opening, the fluid outflow opening and the leadthrough passage are arranged in such a way that, at each valve actuator the fluid supply opening rests congruently on the coupling opening of the high pressure line and the fluid outflow opening rests congruently on the coupling opening of the recycling line, and the hollow peg engages the centering opening in a form-locking manner.

2. The module as recited in claim 1, wherein in the actuator housing, two blind hole-like accommodating chambers are provided per each electrical control valve, the accommodating chambers each opening out onto a housing surface that faces away from the planar housing surface, and wherein a connecting channel extends from the bottom of each accommodating chamber to the inside of the hollow peg.

3. The module as recited in claim 1, wherein in the planar housing surface, ring grooves surrounding the fluid supply opening and the fluid outflow opening are provided for accommodating sealing rings.

4. The module as recited in claim 1, wherein a cavity coaxial with the hollow peg is provided in the actuator housing, and wherein a hydraulic working cylinder connected to the fluid supply opening and the fluid outflow opening is installed into the cavity, and wherein an operating piston guided in a working cylinder in an axially shiftable manner is connected to the valve shaft of the gas exchange valve that is inserted into the hollow peg.

5. The module as recited in claim 1, wherein through holes are provided in the actuator housing for allowing passage of fastening screws adapted to be screwed into threaded holes in the cylinder head.

* * * * *